US005619238A

United States Patent [19]

Higuma et al.

[11] Patent Number: 5,619,238

[45] Date of Patent: Apr. 8, 1997

[54] METHOD OF MAKING REPLACEABLE INK CARTRIDGE

[75] Inventors: Masahiko Higuma, Tohganc; Masami Ikeda; Naohito Asai, both of Yokohama; Tsutomu Abe, Isehara; Toshio Kashino, Chigasaki; Seiichiro Karita, Yokohama, all of Japan

[73] Assignee: Canon Kabushiki Kaisha, Tokyo, Japan

[21] Appl. No.: 94,313

[22] Filed: Jul. 21, 1993

[30] Foreign Application Priority Data

Jul. 24, 1992 [JP] Japan ..... 4-198474
May 25, 1993 [JP] Japan ..... 5-122620

[51] Int. Cl.[6] ..... B41J 2/175
[52] U.S. Cl. ..... 347/86
[58] Field of Search ..... 347/87, 86, 85

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,509,062 | 4/1985 | Low et al. | 346/140 R |
| 4,558,333 | 12/1985 | Sugitani et al. | 346/140 R |
| 4,571,599 | 2/1986 | Rezanka | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,771,295 | 9/1988 | Baker et al. | 346/1.1 |
| 4,794,409 | 12/1988 | Cowger et al. | 346/140 R |
| 4,920,362 | 4/1990 | Cowger | 346/140 R |
| 4,994,824 | 2/1991 | Winslow | 346/140 R |
| 4,994,828 | 2/1991 | Smart | 354/21 |
| 5,025,271 | 6/1991 | Baker et al. | 346/140 R |
| 5,095,321 | 3/1992 | Saito et al. | 346/140 R |
| 5,103,243 | 4/1992 | Cowger | 346/1.1 |
| 5,119,115 | 6/1992 | Buat et al. | 347/86 |
| 5,155,502 | 10/1992 | Kimura et al. | 346/140 R |
| 5,157,421 | 10/1992 | Kitahara | 347/86 |
| 5,162,817 | 11/1992 | Tajika et al. | 346/140 R |
| 5,182,581 | 1/1993 | Kashimura et al. | 346/140 R |
| 5,221,334 | 6/1993 | Ma et al. | 347/100 |
| 5,237,342 | 8/1993 | Saikawa et al. | 346/140 R |
| 5,262,802 | 11/1993 | Karita et al. | 347/87 |
| 5,430,471 | 7/1995 | Nakajima et al. | 347/87 |

FOREIGN PATENT DOCUMENTS

| | | |
|---|---|---|
| 0139508 | 5/1985 | European Pat. Off. . |
| 0320165 | 6/1989 | European Pat. Off. . |
| 0373302 | 6/1990 | European Pat. Off. . |
| 0378240 | 7/1990 | European Pat. Off. . |
| 0419192 | 3/1991 | European Pat. Off. . |
| 0486309 | 5/1992 | European Pat. Off. . |
| 0490579 | 6/1992 | European Pat. Off. . |
| 0488829 | 6/1992 | European Pat. Off. . |
| 0493058 | 7/1992 | European Pat. Off. . |
| 0529625 | 3/1993 | European Pat. Off. . |
| 54-056847 | 5/1979 | Japan . |
| 56-067269 | 6/1981 | Japan . |
| 57-016385 | 1/1982 | Japan . |
| 2039213 | 1/1982 | Japan . |
| 57-073623 | 5/1982 | Japan . |
| 59-098857 | 6/1984 | Japan . |
| 59-123670 | 7/1984 | Japan . |
| 59-138461 | 8/1984 | Japan . |
| 60-071260 | 4/1985 | Japan . |
| 63-087242 | 4/1988 | Japan . |
| 7021423 | 2/1989 | Japan . |
| 02000522 | 1/1990 | Japan . |
| 02214666 | 8/1990 | Japan . |

*Primary Examiner*—John E. Barlow, Jr.
*Attorney, Agent, or Firm*—Fitzpatrick, Cella, Harper & Scinto

[57] ABSTRACT

A method of making a replaceable ink cartridge uses a molded, one-piece container body with an open bottom, elongated front, back and top walls, two side walls providing major surfaces of the cartridge, and a partition attached to the side walls and extending from the top wall toward the open bottom to divide the container body into first and second compartments. A sponge-like absorbent material is inserted into the second compartment through the open bottom, which is then sealed with a bottom wall, so that the cartridge has first and second chambers communicating with each other through an opening formed by a gap between the partition and the bottom wall.

45 Claims, 14 Drawing Sheets

METHOD OF MAKING REPLACEABLE INK CARTRIDGE

BACKGROUND OF THE INVENTION

Field of the Invention

The present invention relates to an ink jet cartridge containing liquid ink, a manufacturing method thereof, an ink jet head and printer using the cartridge, and is usable with a copying machine, a facsimile machine or another recording apparatus, communication apparatus, office equipment, combined machine or printer.

Heretofore, an ink cartridge for an ink jet recording apparatus may have been integrally formed with an ink jet head, and when the ink in the cartridge is used up, the unified head and container are disposed of. The quantity of the ink remaining in the cartridge is decided by the ink retaining capacity of a sponge (vacuum producing material) occupying the entirety of the space in the cartridge, and it is relatively large. Japanese Laid-Open Patent Application No. 87242/1988 discloses such an ink container. The ink container contains a foamed material, and it is integral with an ejection orifices. In such an ink container, in order to accommodate the ink in the porous material such as foamed polyurethane material, the production of the vacuum and the ink retention (prevention of ink leakage from the ink container) are accomplished by the capillary force of the foamed material. However, the foamed material is required to be filled in the entirety of the ink container, and therefore, the quantity of ink therein is limited, and the quantity of non-usable ink is relatively large. This means that the ink use efficiency is low. It is difficult to detect the remaining amount of the ink therein. In addition, during the ink consumption period, the negative pressure gradually changes, and therefore, it is difficult to maintain a substantially constant vacuum.

Japanese Laid-Open Patent Application No. 522/1990 discloses that the ink cartridge contains substantially only the ink. More particularly, it discloses an integral ink jet recording head and ink container, comprising a primary ink container for containing a large amount of the ink at an upper position, and a small porous material between the ink jet recording head therebelow. It is stated that ink use efficiency is improved because only the ink is disposed in the ink passage without the porous material contained in the ink container. In addition, a secondary ink container capable of containing the ink is provided at a side of the porous material, which is effective to receive ink that flows from the primary ink container due to expansion of the air in the primary ink container upon a temperature rise (pressure decrease), so as to maintain a substantially constant negative pressure of the recording head during the recording operation.

In this structure, when the recording operation is not carried out, the porous material is filled with a very large amount of the ink from the primary ink container containing a large amount of the ink above the porous material, and therefore, the porous material itself can hardly produce the negative pressure. For this reason, the ink leaks out of the orifice of the ink jet recording head through only small impacts, and therefore, the structure is not practical. If this container is used as a exchangeable ink cartridge to be mounted to an ink jet recording head, the ink can leak out of the porous material, and therefore, it is still not practical.

In an ink cartridge, the ink may be sealingly contained in a bladder, and the negative pressure of the bladder can be maintained constant using a spring structure, but this is expensive, and it is difficult to mass-produce with the correct performance of the spring structure. In the field of the ink jet printing (non-contact type printing) an inexpensive ink cartridge having proper performance has not been accomplished, and has long been desired.

The inventors have investigated from the standpoint of properly supplying the ink corresponding to the ejection of the ink from the recording head during the printing operation and also from the standpoint of preventing ink leakage through the ejection outlet when the printing operation is not carried out. As a result, it has been found that the fundamental structure comprises a chamber for containing substantially only the ink to be supplied to a second chamber containing a vacuum producing material and having an air vent, the first chamber being substantially hermetically closed with the exception of communicating with the first container.

Japanese Laid-Open Patent Application No. 16385/1982 discloses a recording pen having a recording tip which is contacted to a recording material during the recording operation. The recording tip has an ink absorbing and retaining nature, and the ink is supplied thereto. Therefore, the recording tip is exposed to ambience, as contrasted to the ink jet recording apparatus. This Japanese laid-open patent application is directed only to the overflow of the ink through the recording tip.

It comprises as essential elements a first liquid absorbing material, and a second absorbing material which absorbs less ink than the first absorbing material (although absorbing a small amount of the ink), the second absorbing material being disposed above the first absorbing material at a position closer to an air vent, a central chamber from which the recording tip is projected downwardly, and hermetically closed in accommodating chamber to supply the ink to opposite sides of the chamber. With this structure, when the air in the closed ink container expands due to the ambient temperature rise with the result of the ink in the ink container being forced into the first absorbing material, the ink incapable of being retained by the first absorbing material is absorbed by the second absorbing material, so that overflowing droplets of ink from the writing tip can be prevented. It also discloses provision of a constant width groove which is effective, when one of the two closed ink containers contains only air, to permit the expanded air to escape through the air vent. The groove is extended from the bottom end to the top end on a side surface which is different from a partition wall between the central chamber and the closed ink container. When this structure is used for an ink jet recording head, ink leakage through the air vent has been confirmed, as expected because of the fundamental difference between contact recording and non-contact recording. This problem is not recognized in the field of recording pens. In addition, the constant width groove serves to promote the discharge of ink together with air, therefore promotes ink leakage.

Additionally, the ink consumptions of the two ink containers are not the same. If one of the containers becomes empty first, the ink jet recording operation is no longer possible despite the fact that a large amount of ink is remaining in the other ink container. This is because a large amount of air is introduced into the first absorbing material with the result of incapacitating the ink supply. This is against the aim of the present invention.

SUMMARY OF THE INVENTION

Accordingly, it is a principal object of the present invention to provide an improvement to the fundamental structure having a first chamber containing ink and a second chamber containing the vacuum producing material and provided with the air vent for communication with the ambience, the first chamber being substantially hermetically closed with the exception of the communication with the second chamber. The improvement is intended for effective use for ink jet recording or printing.

It is another object of the present invention to provide an exchangeable ink cartridge, an ink jet head and a printer using the same capable of effecting high speed recording, while the vacuum can be maintained substantially constant in a large part of the period from the start of the use to the end thereof of the ink cartridge.

It is another object of the present invention to provide an exchangeable ink cartridge in which the vacuum is produced in the ink cartridge when the recording operation is not effected, thus preventing ink leakage through an opening upon small impact.

It is a further object of the present invention to provide an ink cartridge in which the remaining non-usable ink is minimized.

It is a yet further object of the present invention to provide an exchangeable ink cartridge which is less expensive and from which the ink does not leak out during transportation of itself.

According to an aspect of the present invention, a region of the vacuum producing material that adjacent to air introduction passage does not contain the ink. By doing so, the leakage of the ink through the air vent from the ink cartridge can be prevented against the ambient condition change. Particularly when a sealing member is used to seal the air vent, this aspect of the invention is effective to prevent removal of the sealing member. During the use of the ink cartridge, this region is effective to ensure that the proper amount of the air is introduced into the ink cartridge, thus suppressing variation of the vacuum in the ink jet cartridge. The region adjacent the air introduction passage is completely free from being wetted by the ink, the ink seeping speed is reduced, and therefore, it is desirable. However, it is a possible alternative that the region is once wetted by the ink, and the ink is thereafter removed.

According to another aspect of the invention based on the above-described fundamental structure, the vacuum or negative pressure producing material is compressed or capable of being compressed in the region adjacent an ink supply opening or an ink supply pipe which is provided at a side opposite from the partition wall having a fine communication part or opening between the first chamber and the second chamber. By doing so, a stabilized ink path can be assured in the vacuum producing material from the first chamber. For the purpose of the further stabilization, the ink supply opening is disposed above the small communication part relative to the bottom surface of the ink cartridge. Here, the supply pipe includes an insertion pipe peculiar to the ink jet recording or printing apparatus, and a valve structure or connecting member mounted on the cartridge compressing the vacuum producing member. By doing so, the ink movement direction can be substantially stabilized, so that all of the ink in the first chamber can be used up. After it is used up, the air moves from the partition wall toward the ink supply opening, thus permitting consumption of the ink in the vacuum producing material, and therefore, the amount of the non-usable remaining ink can be minimized.

According to a further aspect of the present invention, a region of the vacuum producing material not compressed by the supply pipe, and the region compressed by the supply pipe are formed in the order named from the partition wall forming the fine communication part to the opposite wall, by which one way ink supply path is formed in the non-compressed region, and in addition, the remaining non-usable ink amount can be further reduced by the ink retaining capacity in the compressed region.

The present invention includes a structure containing one or more of the above-described aspects.

The ink jet cartridge of this invention is usually handled by an operator, and therefore, it is possible that strong force is applied thereto with the result of deformation of the ink container wall. In view of this, it is preferable that an additional partition wall providing a larger clearance than the fine communication part in the ink chamber for containing substantially only the ink. When the cartridge is made of resin material, it is preferable that the thickness of the wall containing substantially only the ink is 0.8 mm (Ti, G in FIG. 29) or more and that the wall thickness of the container containing the vacuum producing material such as a sponge is 1.3 mm (Ts, J in FIG. 20) from the standpoint of the prevention of the deformation. In the ink jet printer of this invention, the ink is discharged by sucking the ink by the sucking means and by ejecting the ink by ejecting means automatically or manually upon mounting of the cartridge on the ink jet printer. This is preferable because the state of the ink in the vacuum generating material can be adjusted before the start of the printing operation, and therefore, the printing function can be performed without influence by the ink cartridge storage conditions.

In the manufacturing method of this ink cartridge according to this invention, the fine communication part can be provided between a partition wall and a covering member by fixing the covering member accommodating the vacuum producing material in a container, to the main body of the ink cartridge. Thus, the vacuum producing material can be stabilized adjacent the fine communication part, and therefore, the mass-production is easy.

The height of the fine communication part provided by the partition wall is larger than an average pore size of the vacuum producing material (preferably the average pore size in the region adjacent the fine communication part) (practically not less than 0.1 mm), and it is preferably not less than 5 mm. If it is less than 3 mm, the further stabilization can be expected. The volume ratio of the vacuum producing material second chamber and the ink containing first chamber is not less than 1:1 and not more than 1:3, practically.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to FIGS. 1–6, there is shown an ink cartridge having an ink supply opening formed in a wall of a vacuum producing material container or chamber that is faced to a partition wall 5 which is cooperative with a bottom surface of the cartridge to form a fine communication part or opening 8.

Figure 1:
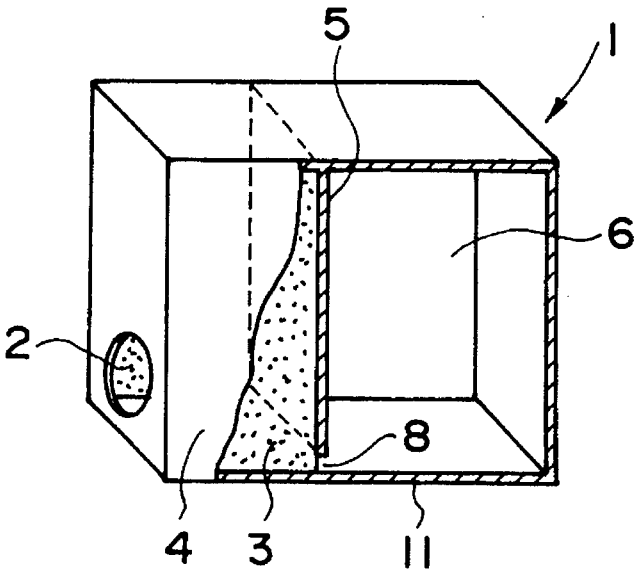
FIG. 1 is a schematic partly broken perspective view of an ink container according to a first embodiment of the present invention.
Figure 2:
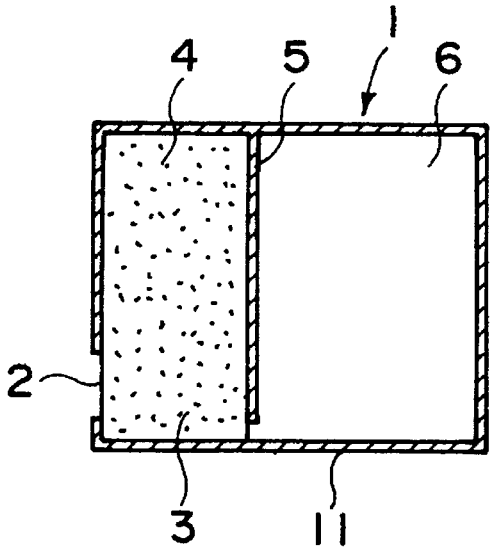
FIG. 2 is a sectional view of the ink container of FIG. 1.

FIG. 1 is a perspective view of the ink cartridge according to a first embodiment, and FIG. 2 is a sectional view of the ink cartridge according to the first embodiment.

As shown in FIGS. 1 and 2, the ink cartridge main body 1 of this embodiment is provided with an ink supply outlet or opening 2 for communication with an ink jet recording head at a position displaced toward the fine communication part in the form of a clearance 8. It comprises a vacuum producing material container 4 for containing the vacuum producing material 3 and an ink container 6 for containing substantially only the ink, which communicates with the container 4 at a bottom portion 11 through the clearance 8 provided by the partition wall 5.

Figure 3A:
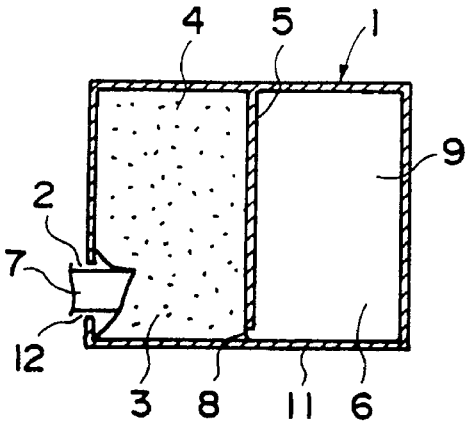
FIGS. 3(*a*)–3(*c*) show examples of connection between the cartridge and the supply pipe.
Figure 3B:
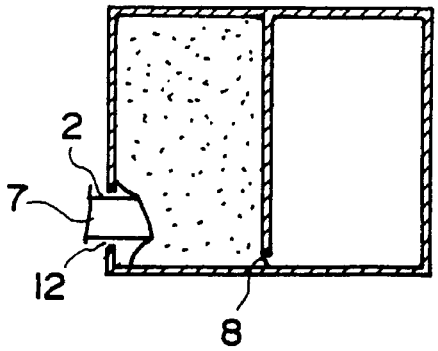
Figure 3C:
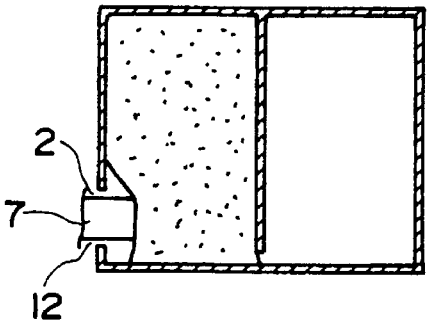

With this structure, the air is supplied through the opening 2. However, what is important is the ink is supplied assuredly from the ink container 6 through the communication part 8 toward the opening 2 along the bottom 11 of the ink cartridge. With the ink supply, the air is introduced in place of the ink in the ink container 6. A description will now be made as to the compressing deformation of the vacuum or negative pressure producing material by the supply pipe in the compressing deformation capable region adjacent the opening. In FIG. 3, a joint member 7 functioning as a supply pipe for supplying the ink to the ink jet recording head has been inserted into an exchangeable ink cartridge according to this embodiment. With this state, the joint member 7 is press-contacted to the vacuum producing member, and the ink jet recording apparatus is operable in this respect. A filter may be provided at an end of the joint member to remove any foreign matter in the ink cartridge.

When the ink jet recording apparatus is operated, the ink is ejected out through orifices of the ink jet recording head with the result of ink absorbing force in the ink cartridge. The ink 9 is supplied by the absorbing force from the ink container 6 through the clearance 8 between the bottom end of the partition and the bottom of the ink cartridge 11 to the vacuum producing material container 4, and to the ink jet recording head through the vacuum producing material 3 and the joint member 7.

By this ink supply, the internal pressure of the ink container 6 which is closed except for the clearance 8 reduces with the result of pressure difference between the ink container 6 and the vacuum producing material container 4. With the continuing recording operation, the pressure difference continues to increase.

However, the vacuum producing material is open to the ambience by a clearance 12 between the joint member and the opening. The air is introduced into the ink container 4 through the clearance 8 between the bottom end of the partition member 8 and the internal bottom surface 11 of the ink cartridge through the vacuum producing material. At this time, the pressure difference between the ink container 6 and the vacuum producing material container is canceled. During the recording operation, this action is repeated, so that a constant negative pressure (vacuum) is maintained in the ink cartridge. Substantially all of the ink in the ink container 6 can be used up except for the ink deposited on the internal wall surface of the ink container, and therefore, the ink use efficiency is improved.

When the recording operation is not performed, the capillary force of the vacuum producing material itself (meniscus force at the interface between the ink and the vacuum producing material) and the like are produced. Particularly, when the ink consumption from the ink container is started, the ink retaining state in the vacuum producing material becomes substantially constant. Since the air collected in the ink container is substantially in a certain degree of vacuum, the pressure balance in the cartridge is extremely stabilized, so that the ink leakage from the ink jet recording head is suppressed.

Figure 4:
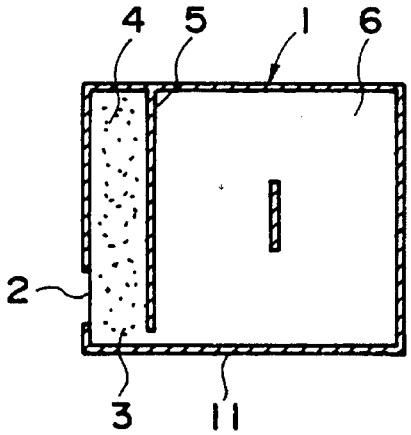
FIG. 4 illustrates a comparison example.

If the vacuum producing material is properly selected in accordance with the ink jet recording head to be used therewith and if the volume ratio between the vacuum producing material container and the ink container, are properly determined, the structure shown in FIG. 4 is possible.

Figure 19A:
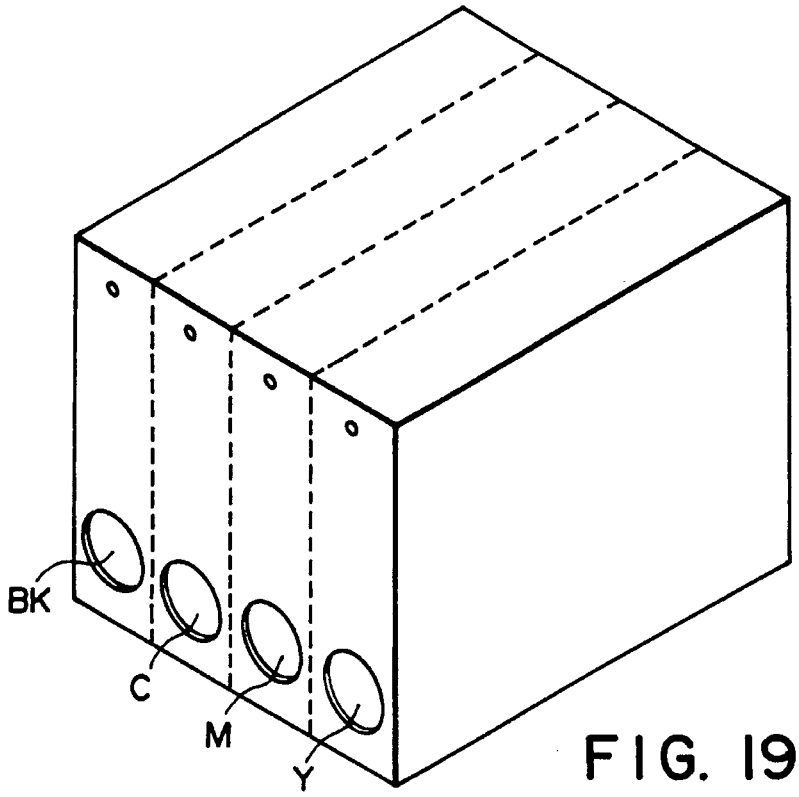
FIGS. 19(A) and 19(B) are perspective views of a color ink container according to an embodiment of the present invention.
Figure 19B:
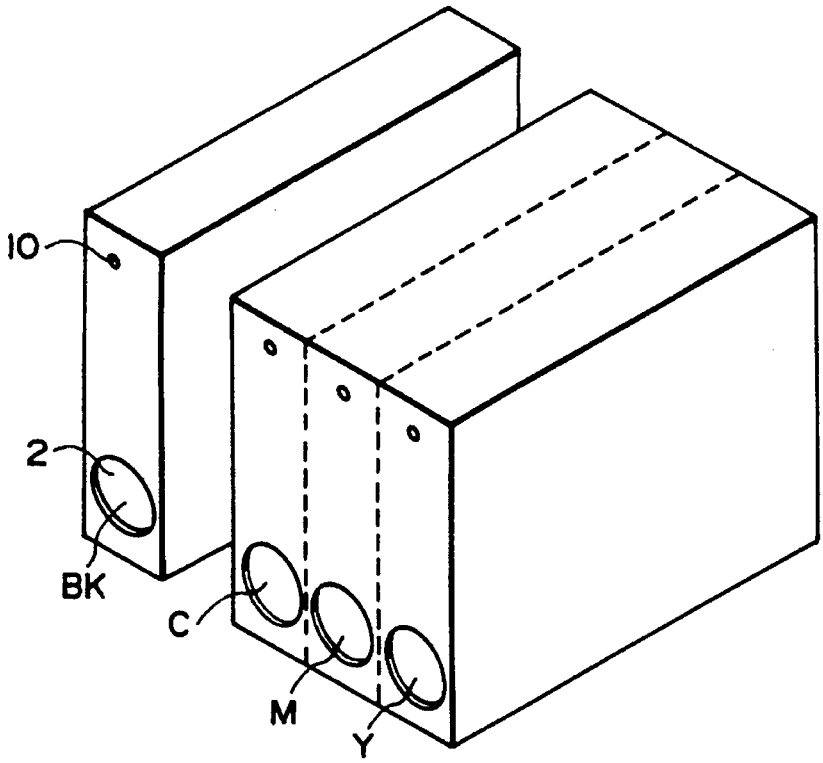

As shown in FIG. 19, in order to use the ink cartridge of this invention in a color ink jet recording, various color inks (black, yellow, magenta and cyan) may be accommodated in separate exchangeable ink cartridges, respectively. These ink cartridges may be unified as shown in FIG. 19(A). The exchangeable ink cartridge may comprise a black container exchangeable ink cartridge which is frequently used and one another color exchangeable cartridge, as shown in FIG. 19(B). Any combination is possible in consideration of the ink jet apparatus. In the exchangeable ink cartridge according to this embodiment, in order to control the vacuum, the following is preferably optimized: material, configuration and dimensions of the vacuum producing material 3, the configuration and dimensions of the partition end, configuration and dimensions of the clearance 8 between the partition end and the ink container bottom 11, the volume ratio between the vacuum producing material container 4 and the ink container 6, the configuration and dimensions of the joint member 7 and the insertion degree thereof into the ink container, the configuration, dimension and mesh of the filter 12, and the surface tension of the ink.

The material of the vacuum producing member may be any known material if it can retain the ink despite the weight thereof, the weight of the liquid (ink) and small vibration. For example, there are sponge-like absorbant materials made of fibers and porous material having continuous pores. It is preferably in the form of a sponge of polyurethane foamed material which is easy to adjust the vacuum and the ink retaining power. Particularly, in the case of the foamed material, the pore density can be adjusted during the manufacturing thereof. When the foamed material is subjected to thermal compression treatment to adjust the pore density, decomposition is produced by the heat with the result of changing the nature of the ink with the possible result of adverse influence to the record quality, and therefore, cleaning treatment is desirable. For the purpose meeting various ink cartridges for various ink jet recording apparatuses, corresponding pore density foamed materials are required. It is desirable that a foamed material not treated by the thermal compression and having a predetermined number of cells (number of pores per 1 inch) is cut into a desired dimension, and it is compressed into the vacuum producing material container so as to provide the desired pore density and the capillary force.

In this embodiment, the clearance 12 is provided between the joint member 7 and the opening 2 for the joint member 7 to permit introduction of the air into the ink cartridge. However, this structure is not limiting to the present invention. Other structure or configuration is usable for the joint member and the joint opening. In the case that the vacuum producing material is a porous material such as a sponge, it is preferable that an end of the joint member 7 is inclined at a certain angle with respect to a joint member inserting direction, since then as shown in FIGS. 3(*a*) and (*b*), the parting of the porous material from the bottom of the ink cartridge is prevented upon insertion of the joint member, and the surface contact between the filter and the vacuum producing material is maintained assuredly. If the insertion amount of the joint member is too large, the tapered end portion might tear the vacuum producing material, and therefore, the surface structure shown in FIG. 3(*c*), is preferable.

Figure 5A:
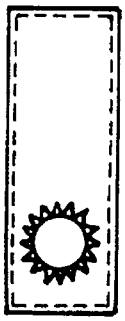
FIGS. 5(*a*)–5(*c*) illustrate ink supply parts used in this invention.
Figure 5B:
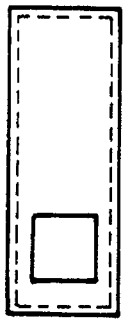
Figure 5C:
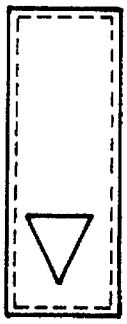

It will be considered that an outer wall of the joint member is provided with grooves. As shown in FIG. 5, the configuration of the opening 2 may be a slot (FIG. 5(*a*)), rectangular (FIG. 5(*b*)), triangular (FIG. 5(*c*)). The preferable configuration of the opening 2 provides a clearance between the joint member, or the configuration is such that it is in contact with the outer periphery of the joint member at the bottom of the opening (bottom of the ink cartridge) and that it is open at the upper portion of the opening.

As described in the foregoing, the exchangeable ink cartridge has a joint opening functioning also as the air introduction opening, and therefore, the structure is simple. The amount of insertion of the joint member 7 into the exchangeable ink cartridge is properly determined through ordinary skill in the art so as to provide a compression region of the vacuum producing member to prevent ink leakage upon the insertion and to prevent ink supply interruption during the recording operation, in consideration of the configuration of the joint member, the vacuum producing material and the configuration of the ink cartridge.

In the foregoing embodiment, it is effective to provide an air vent in the vacuum producing material container, since then the region of the vacuum producing material that does not contain the ink is easily located adjacent the air introduction passage. The reliability in the ink jet recording apparatus against the ambient condition change is improved. The configuration and dimensions of the clearance 8 between the end of the partition wall and the ink cartridge bottom, are not limited. However, if it is too small, the meniscus force with the ink is too strong, and although the ink leakage can be prevented through the joint opening, the ink supply to the vacuum producing material container is difficult, with the possible result of ink supply interruption during use. If it is too large, the opposite phenomenon occurs, and therefore, the height to the partition wall of the fine communicating part is preferably larger than an average pore size of the vacuum producing material (average pore size adjacent the fine communication part, preferably) (practically not less than 0.1 mm), and not more than 5 mm. For the purpose of further stabilization, it is preferably not more than 3 mm. FIG. 7 shows an example of the configuration of the clearance 8. FIG. 7(*a*) shows the structure and configuration most stabilized in the present invention, used in the foregoing embodiment. It is formed with a constant height over the entire width of the cartridge. FIGS. 7(*b*) and (*c*) show examples in which the communication part is formed only a part of the entire width of the cartridge, and is waved. This structure is effective when the entire volume of the cartridge is large. FIG. 7(*d*) shows an example having tunnel-like communicating parts with which the ink is easily moved to the inside of the cartridge, and the air introduction can be concentrated. In the examples of FIGS. 7(*e*) and (*f*) a recess is formed along a vertical direction on the partition wall in the ink container. With this structure, the air having come to the bottom end of the partition wall is effectively introduced into the ink container by the recess, thus increasing the air tracking efficiency.

Figure 6A:
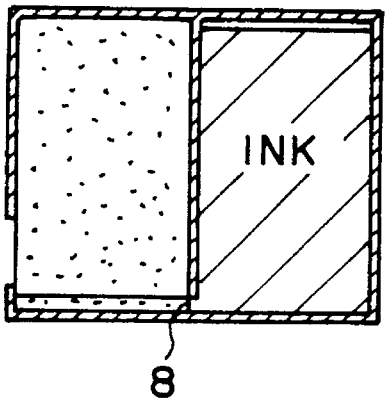
FIGS. 6(*a*)–6(*c*) illustrate a positional relationship between an ink supply portion and the fine communication opening.
Figure 6B:
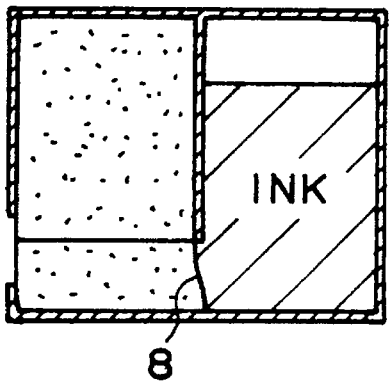
Figure 6C:
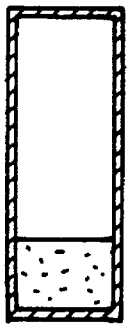
Figure 7A:
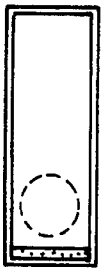
FIGS. 7(*a*)–7(*f*) illustrate examples of the structure of the fine communication part.
Figure 7B:
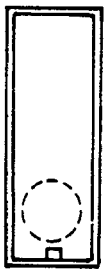
Figure 7D:
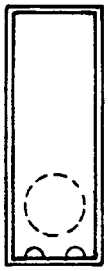
Figure 7E:
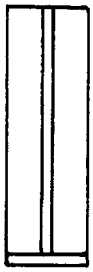
Figure 7C:
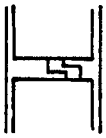
Figure 7F:
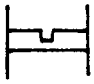
Figure 8A:
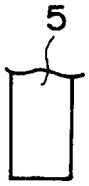
FIGS. 8(*a*)–8(*h*) illustrate configurations of the partition wall at a side of the fine communication part.
Figure 8B:
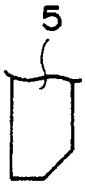
Figure 8C:
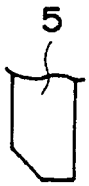
Figure 8D:
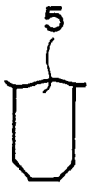
Figure 8E:
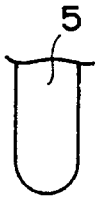
Figure 8F:
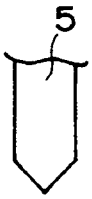
Figure 8G:
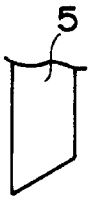
Figure 8H:
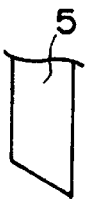
Figure 9A:
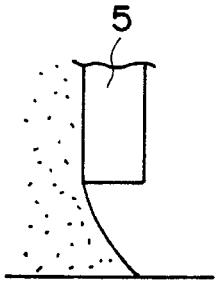
FIGS. 9(*a*)–9(*f*) illustrate states of the absorbing material at an end adjacent the partition wall.
Figure 9B:
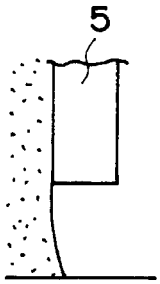
Figure 9C:
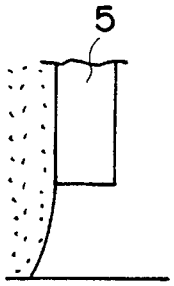
Figure 9D:
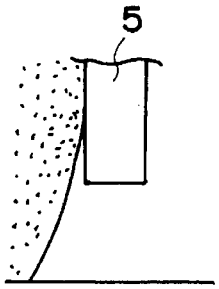
Figure 9E:
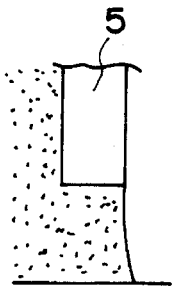
Figure 9F:
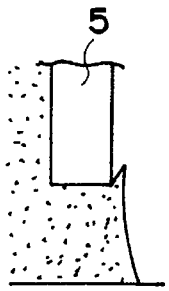
Figure 10A:
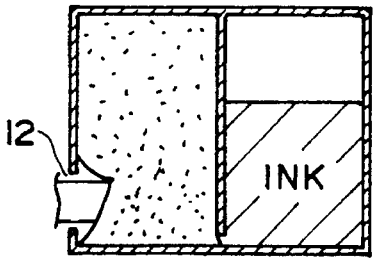
FIGS. 10(*a*)–10(*d*) illustrate the state of the inside of the absorbing material against ambient condition change.
Figure 10B:
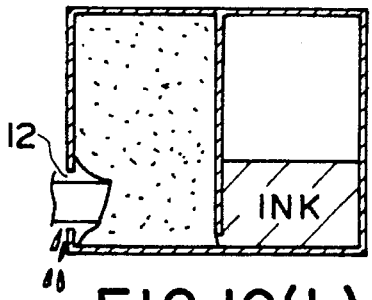
Figure 10C:
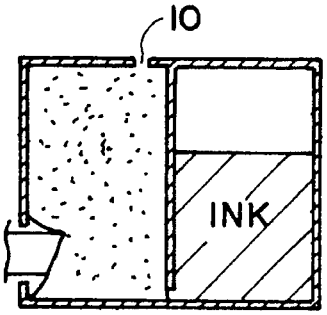
Figure 10D:
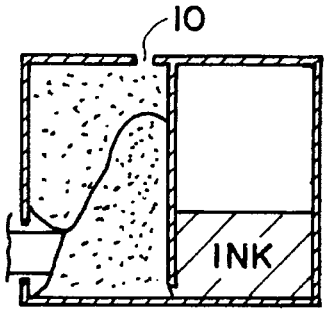

The clearance 8 is also determined in consideration of the position of the joint opening. Referring to FIGS. 6(*a*) and (*b*) the partition wall end is at a position lower than the bottom end of the joint opening in Example (a), and the ink retained in the vacuum producing material is lower than the bottom end of the joint opening, and therefore, the leakage preventing effect is sufficient. In Example (b), the end of the partition wall is at a position higher than the bottom end of the joint opening, and the ink retained in the vacuum producing material is above the bottom end of the joint opening, and therefore, the ink leakage suppressing effect is not sufficient. Therefore, it is preferable to stabilize the advantageous effect of the present invention that the position of the end of the partition wall is not higher that the bottom end of the joint opening by properly determining the dimension of the clearance 8. Although it is dependent on the configuration and dimensions of the exchangeable ink cartridge, the height of the clearance 8 is selected in the range of 0.1–20 mm. Further preferably it ranges from 0.5–5 mm approximately. The configuration of an end of the partition wall may be varied if the consideration is paid to the position relative to the joint opening, as will be understood from FIGS. 8(*a*)–(*h*).

As regards the boundary between the end of the partition wall 5 and the vacuum producing material 3, various structures are considered. This is shown in FIG. 9. In the structure of FIGS. 9(*a*)–(*d*), the vacuum producing material is not compressed by the end of the partition wall, and the density of the vacuum producing material is not locally increased, and therefore, the flow of the ink and the air is relatively smooth, and for this reason, it is preferable for a high speed recording or color recording. On the other hand, the examples of FIGS. 9(*e*) and (*f*) show the vacuum producing material 3 compressed by the end of the partition wall, whereby the density of the material is increased, and therefore, the flow of the ink and the air is obstructed, but the ink leakage or the like can be effectively prevented against slight ambient condition change. Therefore, they are properly determined by one skilled in the art, on the basis of the ink jet recording apparatus with which the ink cartridge is used and the ambient condition under which the ink cartridge is used.

The volume ratio between the vacuum producing material container 4 and the ink container 6, is determined in consideration of the ambient condition under which the ink cartridge is used and the ink jet recording apparatus with which it is used. Also, the relation with the used vacuum producing material is important. In order to improve the use efficiency of the ink, it is desirable to increase the volume of the ink container. In that case, a vacuum producing material capable of producing high vacuum (high compression ratio sponge), is effective. Therefore, the preferable ratio ranges from 1:1–1:3 practically. In this case, the vacuum producing performance of the vacuum producing member is increased with increase of the relative volume of the ink container.

The configuration, dimension and mesh of the filter 11 can be properly determined by one skilled in the art depending on the ink jet recording apparatus with which the ink cartridge is used. However, in order to prevent the nozzle from being clogged by foreign matter introduced from the ink cartridge, the passing area thereof is smaller than the size of the orifice.

The quantity of the ink in the ink cartridge is not limited except for the internal volume of the ink cartridge. In order to maintain the proper negative structure immediately after the exchangeable ink cartridge is unpacked, the ink may be contained to the extent of the volume limit in the ink container. However, the vacuum producing material is preferably lower than the ink retaining capacity of the material. Here, the ink retaining capacity which can be retained solely by the material when the ink is contained therein.

In the ink cartridge having a closed system ink container, when an external ambient condition change such as temperature rise or pressure reduction, occurs when it is loaded in the ink jet recording apparatus, the air and the ink expands in the ink container to push the remaining ink out of the ink cartridge with the possible result of ink leakage. However, in the exchangeable ink cartridge of this invention, the volume of air expansion in the closed ink container, including ink expansion (although the amount is small) in accordance with the worst ambient condition change, is estimated, and the amount of the displaced ink from the ink container is to be accommodated in the vacuum producing material container. In this case, it is very effective to provide the vacuum producing material container with an air vent 10 in addition to the joint opening, as shown in FIGS. 10(*c*) and (*d*), since then the ink displaced into the vacuum producing material from the ink chamber by the expansion of the air can be guided toward the air vent. The position of the air vent is not limited if it is higher than the ink supply outlet of the vacuum producing member container. However, in order to make the ink flow in the vacuum producing material under the ambient condition change remote from the joint opening, it is preferably away from the joint opening. The number, configuration and size of the air vent are properly determined ordinary skill in the art in consideration of the ink evaporation or the like.

During transportation of the ink cartridge itself, it is preferable that the ink supply outlet and/or the air vent is hermetically sealed by a sealing member to prevent ink evaporation or to be prepared for the expansion of the air in the ink cartridge. The sealing member may be a single layer barrier which is a so-called barrier material in the packing field; a compound plastic film having several layers, or such material reinforced by paper or cloth or another reinforcing material or aluminum foil, are preferable. It is further preferable that a bonding layer of the same material as the main body of the ink cartridge is used to fuse fixing the barrier material, thus improving the hermetical sealing property.

In order to suppress the evaporation of the ink from the ink cartridge and the introduction of the air thereinto, it is effective that the air in the pack is removed after the ink cartridge is inserted therein. The packing member may preferably of the same barrier material as described with respect to the sealing member in consideration of the permeabilities of the liquid and the air.

By such proper selection of the packing, the ink does not leak out during the transportation of the ink cartridge itself.

The material of the main body of the ink cartridge may be any known moldable material if it does not have any adverse influence to the liquid ink jet recording ink or if it has been treated for avoiding the influence. The productivity of the ink cartridge is also considered. For example, the main body of the ink cartridge is separated into a bottom wall 11 and an upper container body portion, and they are each integrally molded from plastic resin material, respectively. The absorbant vacuum producing material is inserted into the container body through the open bottom, and thereafter, the bottom wall and upper container body portion are fuse-bonded, thus providing the main container of the ink cartridge. If the plastic material is transparent or semitransparent, the ink in the ink container can be observed externally, and therefore, the timing of ink cartridge change may be expected. In order to facilitate the fusing of the bonding material or the like, it is preferable to provide a projection 15 shown in the FIG. 11. From the standpoint of design, the outer surface of the main body of the ink cartridge may be grained.

The ink can be loaded through pressurizing or pressure-reduction method. Provision of an ink filling opening in either of the chambers of the container is preferable since then the ink cartridge opening is not contaminated. After the filling, the ink filling opening is plugged by a plastic or metal plug.

The configuration, dimension or the like of the ink cartridge according to this invention can be modified without departing from the sprit of the present invention.

As described in the foregoing, the exchangeable ink cartridge is reliable during the transportation thereof, and a high use efficiency ink cartridge can be provided with simple structure.

The proper vacuum from the start to the end of the use can be maintained when the recording operation is carried out or is not carried out, while permitting high speed recording. Under the ambient conditions of use of the ink jet recording apparatus, the possibility of the ink leakage can be minimized.

The exchangeable ink cartridge of this invention is easy to handle so that the ink does not leak out when it is loaded into the ink jet recording apparatus, and the possibility of erroneous operation can be avoided.

Figure 11A:
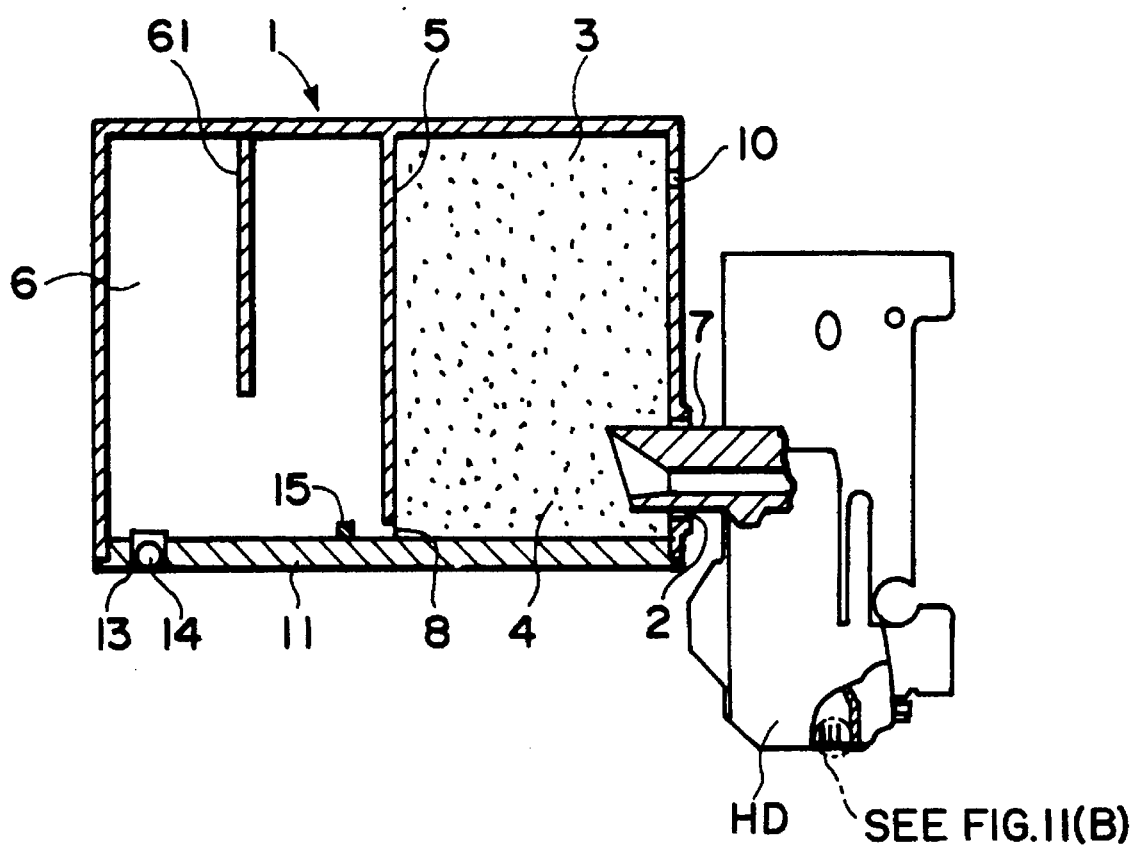
FIGS. 11(A)–11(B) illustrate a manufacturing method according to an embodiment of the present invention, and illustrates an ink jet head.
Figure 11B:
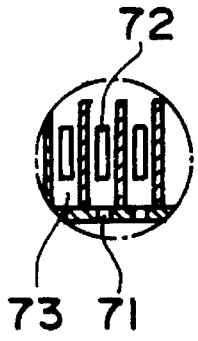

FIGS. 11(A)–11(B) illustrate a manufacturing method of an ink container cartridge. A one-piece, integral container body of the cartridge (left down hatching) comprises a baffle plate 61 and two compartments separated by the partition wall 5. An ink absorbing material 4 functioning as the vacuum producing material is inserted into the container compartment which is close to the opening 2. Thereafter, a bottom wall member 11 functioning as the covering member is unified to the main body. FIG. 11(A) also shows the state in which the recording head HD is loaded in the ink container 1. The ink container 1 is constituted by a container partitioned into two chambers by a partition wall 5, and the open bottom portion is covered by a flat bottom member 11 constituting the bottom of the ink container. Thus, by a simple structure, the fine communication opening 8 can be provided by the end of the partition wall.

The air vent 10 is disposed on the same surface as having the ink supply outlet 2, but above the opening.

The joint portion 7 functioning as the ink port is inserted into the opening of the ink container, and the recording head is mounted thereto. The joint portion 7 is inclined so that the top portion is more forward than the bottom portion. The ink passage in the joint is in the form of a horn opening upwardly in the Figure. With this structure, the ink can be properly supplied to the recording head from the ink absorbing material.

The ink jet recording apparatus comprises heat generating element 72 for producing thermal energy to eject the ink through ejection outlets 71 of the nozzles 73, wherein the thermal energy is effective to cause state change in the ink. In this case, high density, fine images can be provided by the stabilized ink supply performance, particularly in the case of color recording.

As described in the foregoing, the ink cartridge according to this invention provides high reliability during the transportation thereof, and the use efficiency of the ink is high.

In addition, the proper vacuum is maintained from the start to the end of the use thereof when the recording operation is carried out or is not carried out, when permitting high speed recording operation. In addition, ink leakage can be prevented under condition of use of the ink jet recording apparatus.

Additionally, the exchangeable ink cartridge according to this invention is easy to handle, and the ink does not leak out when it is mounted or demounted relative to the ink jet recording apparatus. Therefore, erroneous operation in the mounting thereof can be avoided.

The manufacturing method of the ink cartridge will be described further. When the closed generally sealed first chamber (although there is the fine communication opening 8 between the ink containing first chamber 6 and the negative pressure producing material containing second chamber 4, ink is discharged only when the air and the ink are exchanged with each other), and the vacuum producing material containing second chamber 4 are complete, liquid ink is filled through an access opening 13 at the ink container chamber side in the covering member 11. When the ink is supplied in this manner, a substantial part of the vacuum producing material 4 receives the ink through the fine communication opening.

However, the chamber 4 is only partially filled so that the region of the vacuum producing material 3 adjacent the air vent is not supplied with the ink to provide ink-free region. Thereafter, the opening 13 is sealed closed by a ball 14. Then, the opening 2 and the air vent are sealed closed by the same sealing member S as shown in FIG. 12 (it may be separate members).

Figure 12:
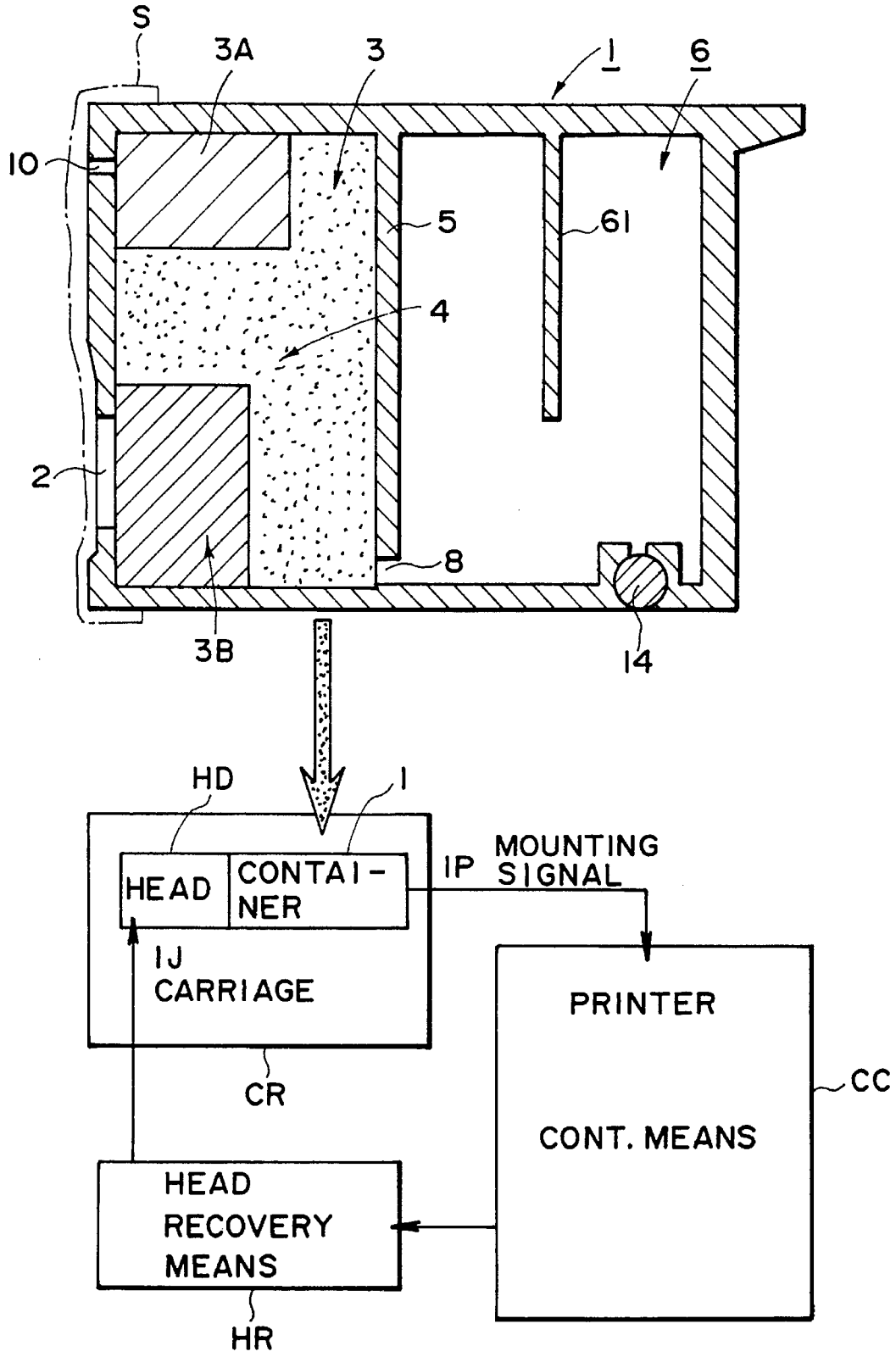
FIG. 12 illustrates an ink jet printer and an ink cartridge usable therewith.

FIG. 12 shows such an ink jet cartridge before start of use. In this Figure, the ink chamber 6 is filled with liquid ink.

FIG. 12 shows the closed state ink jet cartridge 1 with the printer which is used therewith. A region 3A of the vacuum producing material adjacent to the air vent portion 10 does not contain the ink at an upper portion of the cartridge. A region 3B of the vacuum producing material below the region 3A is compressed by insertion of the ink supply pipe (not shown). The vacuum producing material portion other than those regions 3A and 3B, are not externally influenced and simply functions to retain the ink. The region 3B is faced to the outlet 2 for the ink supply to the recording head provided on the same surface but below the air vent 10. The outlet is above the fine communication opening 8, and the above-described structure is used. The cartridge 1 of FIG. 12 becomes usable by removing the sealing member S. Since the region 3A does not retain the ink, the ink does not leak out even if vibration or pressure change is imparted upon the removal of the sealing member.

In the ink container of this invention, the ink is not retained in the region of the vacuum producing member that is close to the air vent or air communication part, irrespective of whether the ink cartridge is being used or not used. By doing so, the leakage of the ink from the ink cartridge through the air vent can be prevented even when the ambient condition varies. Particularly, when the sealing member closes the air vent, the sealing member can be prevented from peeling off. During the use, the region is effective to permit air supply corresponding to the consumption of the ink, so that the change of the vacuum in the ink cartridge can be suppressed. If the region of the vacuum producing material adjacent to the air vent has never been wetted by the ink at all, it is preferable to decelerate the ink seeping speed. However, the region thereof may be wetted by the ink beforehand, and thereafter, the ink may be removed from this region.

In the embodiment of this invention, the ink supply outlet or the compressed part of the vacuum producing material (compressible) by the ink supply pipe is present at a side opposed to the partition wall constituting the fine communication opening, by which the effective ink supply path can be stably provided in the vacuum producing material in the second chamber. This can be further stabilized by placing the ink supply outlet above the fine communication opening relative to the bottom surface of the ink cartridge.

Because of this arrangement, the ink moving direction can be substantially made constant, and therefore, the ink can be completely consumed from the first chamber, that is, the ink container chamber. After the use-up of the ink in the ink container chamber, the air exits so as to move the ink toward the outlet from the partition wall in the direction for canceling the vacuum in the ink container chamber, as a result, the ink in the vacuum producing material can be consumed further, thus minimizing the nonusable remaining amount of the ink.

There are provided a region of the vacuum producing material not compressed by the supply pipe and the region thereof compressed by the supply pipe in this order in a direction from the partition wall constituting the fine communication opening to the side face thereto, and therefore, the non-compressed region provides a one-way ink path, and the ink retaining capacity of the compressed region can further reduce the remaining amount of the ink.

The ink jet printer is provided with a recording head recovery means HR which carries out ink ejection or ink sucking by sucking means automatically or manually in response to mounting of the cartridge 1 thereto. By doing so, the state of the ink in the vacuum producing material can be corrected before the start of the printing operation. Therefore, the cartridge performance can be used from the start of the printing irrespective of the state in which cartridge has been placed.

In FIG. 12, the ink container 1 mounted to the ink jet head HD mounted on a scanning type carriage CR has been deprived the sealing tape. The container mounted on the ink jet carriage CR receives through the outlet 2 the ink supply pipe, by which the vacuum producing material 3 is compressed in the compressible region 3*b*. In this embodiment, the vacuum producing member 3 is deformed toward the fine communication opening 8. At this time, the mounting of the container is detected by detecting means (not shown) in the form of mechanical or electrical detecting means, which produces mounting signal IP into the printer control means CC. In response thereto, the recovery means HR is actuated before the start of the recording operation to discharge the ink in the ink container, thus improving the state of the ink in the ink container.

Figure 13A:
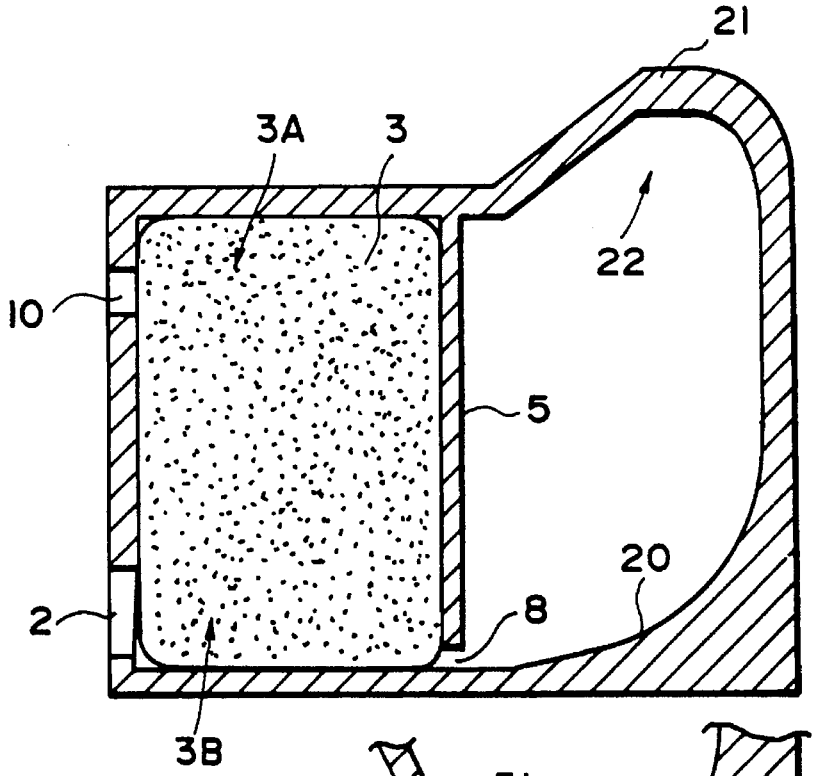
FIGS. 13(A)–13(D) illustrate modified embodiments of the present invention.

In FIG. 13(A) there is shown an ink jet cartridge which is a modification of that of FIG. 12 in which the inside surface of the ink accommodating chamber is modified, and the top part thereof is correspondingly modified into a space 22. The inside surface 20 provides a curved surface which rises away from the fine communication opening 8. This structure is effective to supply into the vacuum producing material 3 fine droplets of ink remaining on the wall of the inside surface 20 by the surface tension of the ink, and also to provide a grip 21 for the operator, thus preventing deformation of the ink container upon manipulation thereof.

Figure 13B:
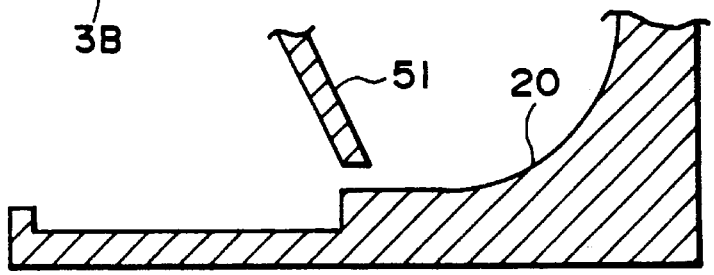
Figure 13C:
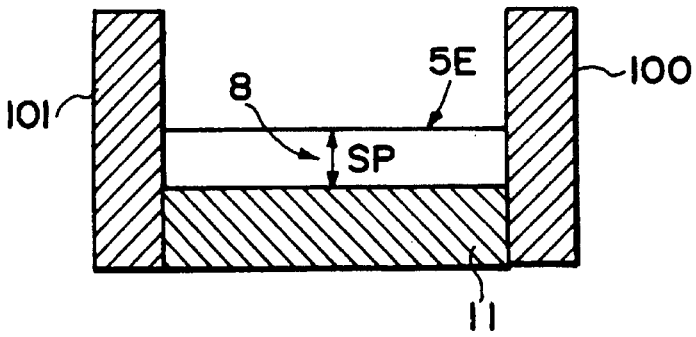

FIG. 13(B) shows another modification in which the partition wall 51 is inclined so that the capacity is larger in the ink accommodating chamber or ink container than in the vacuum producing material container. FIG. 13(C) shows an embodiment which has been produced by the manufacturing method described hereinbefore. A covering member 11 constituting the clearance or gap 8 with the partition wall 5 is inserted and fixed between side plates 101 and 100 of the cartridge main body. Designated by a reference 5E is an end of the covering member 11. In the case of FIG. 13(C), the clearance SP is not constant if the bonding is not uniform.

Figure 13D:
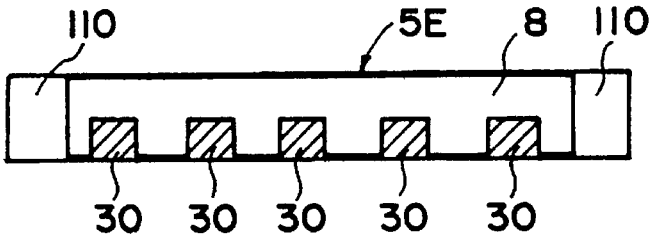

In view of this, it is preferable that spacers 110 contact the end 5E of the partition wall, as shown in FIG. 13(D), at the opposite ends. The spacer 110 is preferably provided on the covering member 11. Projections 30 in the space SP may be provided on the covering member to enhance the collection of the air into the ink container.

Figure 14A:
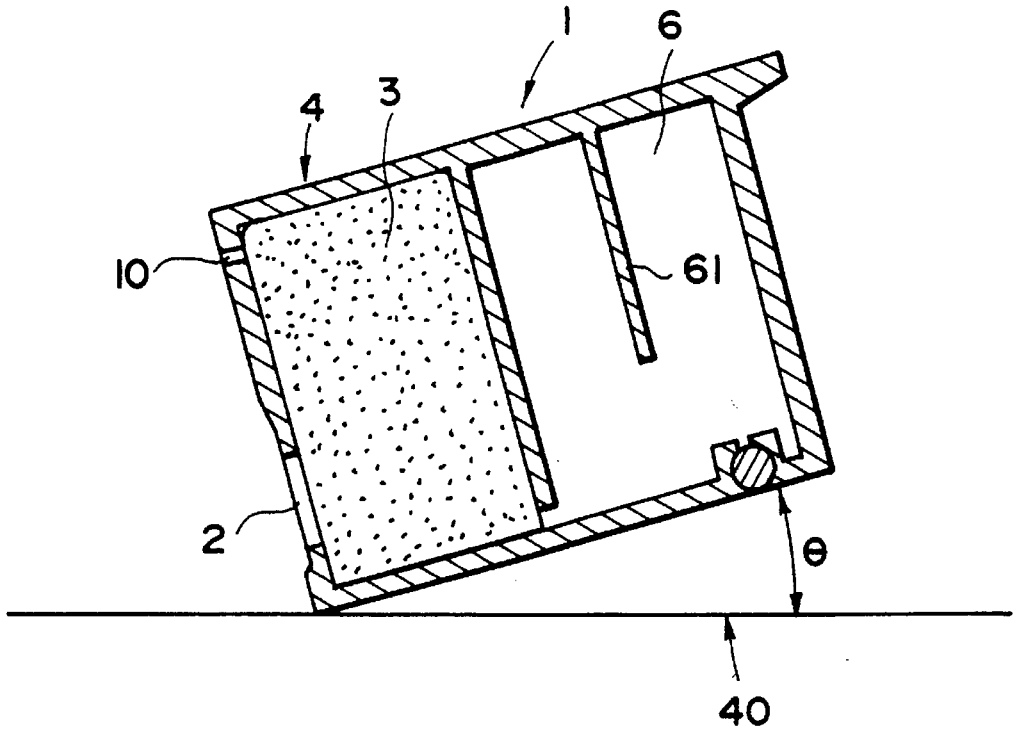
FIGS. 14(A) and 14(B) are sectional views illustrating permissible inclination in use, of the ink cartridge.
Figure 14B:
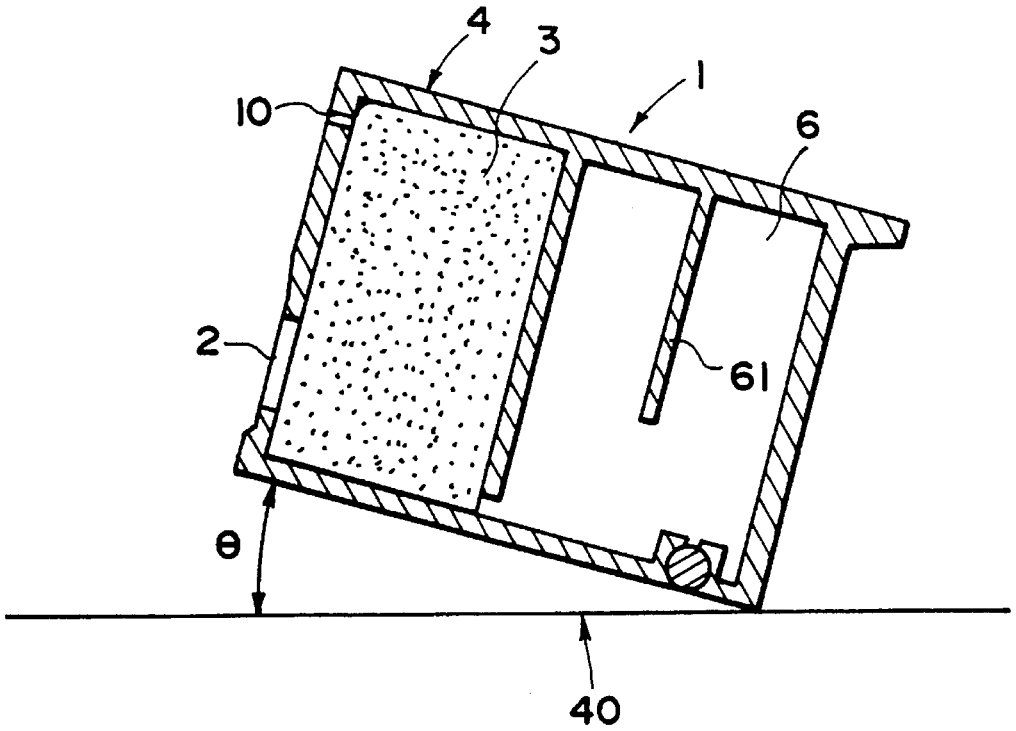

FIGS. 14(A) and (B) show an inclination range capable of printing operation or ink supply. Designated by a reference numeral 40 is a horizontal line. It is preferable that the fine communication opening is at a lower position. Ideally, bottom surface of the cartridge is parallel with the horizontal plane 40. Practically, however, in the case of a two chamber structure as in this embodiment, the inclination is permissible in the range $0 \leqq \theta \leqq 15$ degrees. When it is reciprocated on a scanning carriage, it is preferably $0 \leqq \theta \leqq 5$ degrees.

The vacuum producing material used in this embodiment may be constituted by a plurality of vacuum producing material members. However, in that case, the resultant interface between the members might permit movement of the air at the interface, as the case may be. In view of this, single porous material member is preferable for the vacuum producing material.

The ink container (chamber) performs its function if it has an ink capacity larger than that of the vacuum producing material accommodating chamber.

A description will be made of a partition plate 61 in the ink accommodating chamber. When the ink container (cartridge) is handled by the operator, or during the transportation thereof, the external wall of the cartridge may be deformed with the possible result that the ink is leaked through the orifice from the ink jet recording head or that the ink is leaked out through the air vent provided for equalizing the pressure in the cartridge with the ambient pressure.

In this embodiment, this problem is solved, thus preventing the ink leakage during the handling or during the transportation or even if the temperature or the pressure changes. In addition, the use efficiency is still high.

Figure 15A:
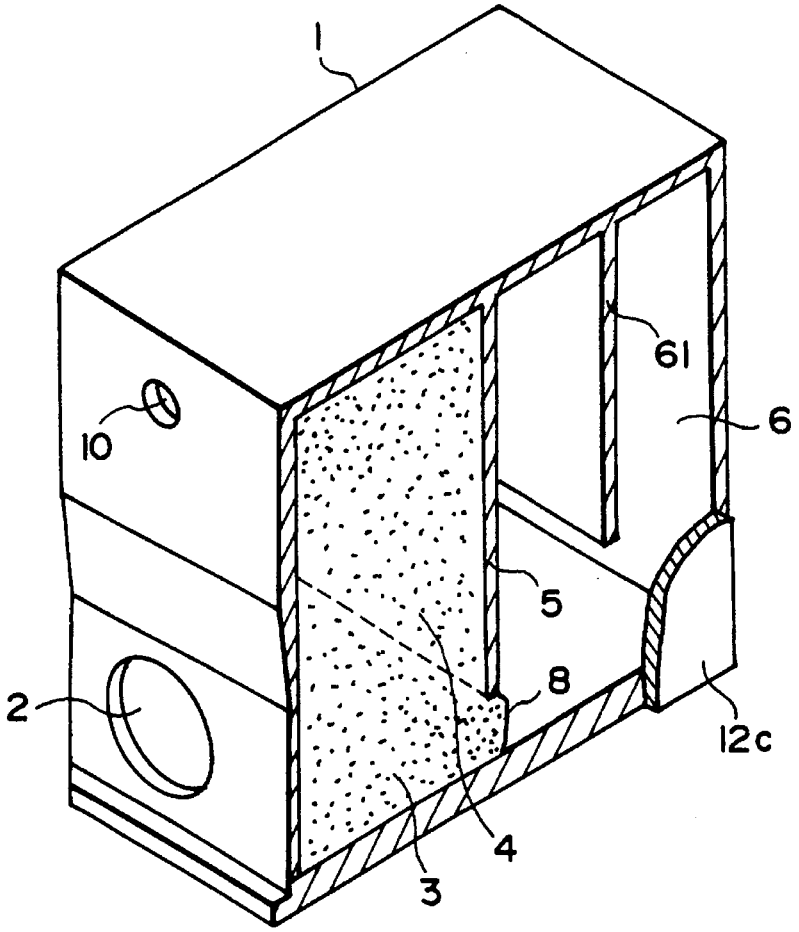
FIGS. 15(A) and 15(B) show configurations in an embodiment of the present invention.
Figure 15B:
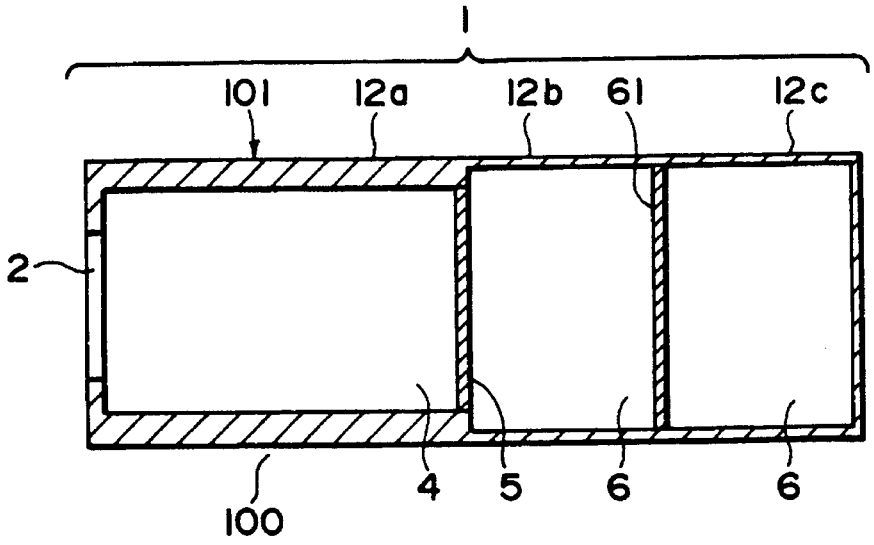
Figure 16A:
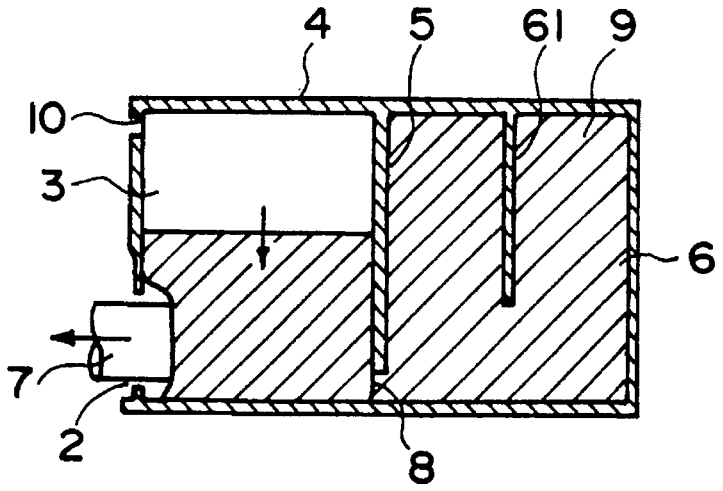
FIGS. 16(*a*)–16(*c*) illustrate changes in the cartridge in a printing operation.
Figure 16B:
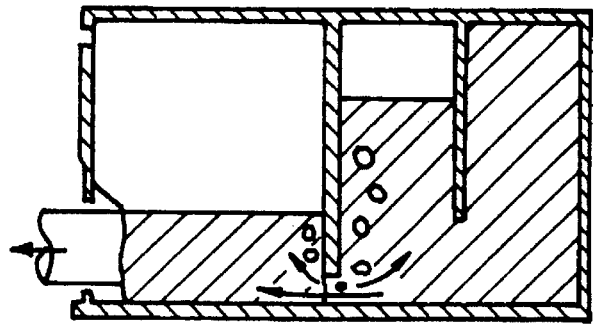
Figure 16C:
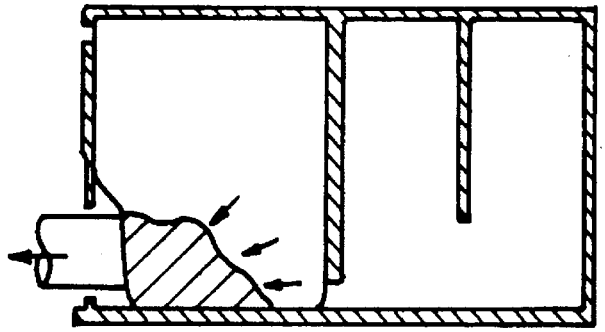
Figure 17:
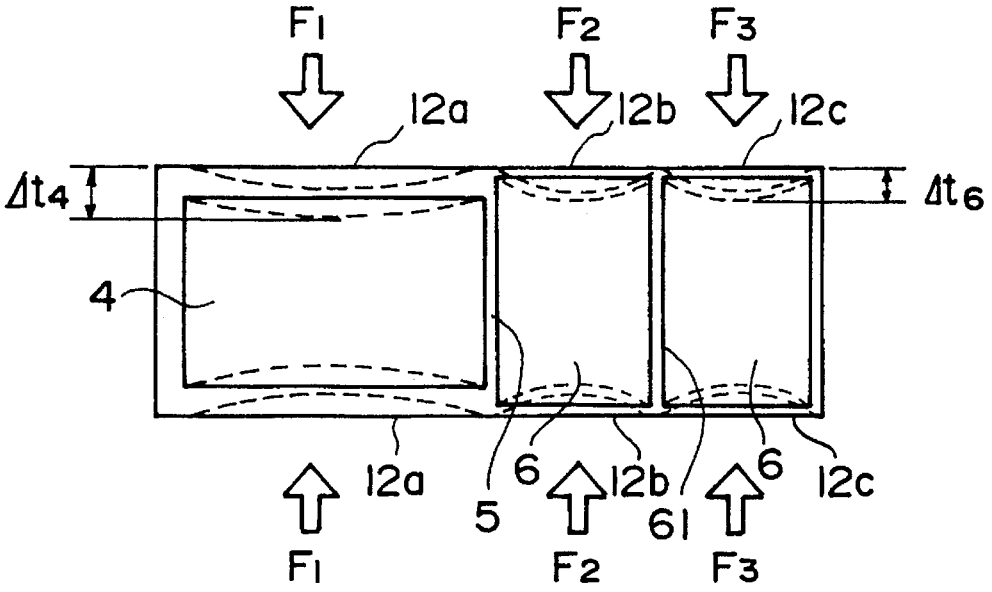
FIG. 17 illustrates pressure to the external wall of the cartridge according to an embodiment of the present invention.

FIG. 15(A) is a perspective view of the ink container of this embodiment, and FIG. 15(B), is a sectional view thereof. FIG. 16 illustrates an ink supply operation of this embodiment. FIG. 17 illustrates deformation of the side wall when it receives load.

As shown in FIGS. 15(A) and (B), the main body of the ink cartridge 1 comprises an outlet 2 for communication with the ink jet recording head and an air vent 10 for permitting introduction of the air, disposed above the outlet 2, vacuum producing material 3 for retaining the ink for the recording, a vacuum producing material container 4 for containing the vacuum producing material 3 and provided with the outlet 2 and the air vent 10, and an ink container (chamber) 6 for containing the ink in communication with the vacuum producing material container 4 through a clearance 8 below a rib 5. The ink container 6 and the vacuum producing material container 4 communicate with each other through a clearance 8 formed between an end of the rib 5 and the bottom surface. A partition plate 61 connects the opposite side walls leaving a gap not less than the clearance 8 at the bottom. FIG. 16(*a*) is a sectional view in the state in which the ink jet recording apparatus is operable after a joint member 7 for supplying the ink to the ink jet recording head is inserted into the opening 2 of the ink cartridge main body 1 to press-contact the vacuum producing material 3. The end opening of the joint member 7 may be provided with a filter to remove foreign matter in the ink cartridge.

When the ink jet recording apparatus is operated, the ink is ejected through the orifice of the ink jet recording head, so that ink absorbing force is produced in the ink container. The ink 9 is supplied to the ink jet recording head from the ink container 6 through the clearance 8 between an end of the rib 5 and the bottom of the ink cartridge 11 to the vacuum producing material container 4, and through the vacuum producing material 3 to the joint member 7. By this, the pressure of the ink container 6 which is closed except for the clearance 8, reduces with the result of pressure difference between the ink container 6 and the vacuum producing material container 4. With the continued recording operation, the pressure difference continues to increase, however since the vacuum producing material container 4 is open to the air through the air vent 10. As shown in FIG. 16(*b*), the air enters the ink container 6 through the vacuum producing material 3 and the clearance 8. By this, the pressure difference between the ink container 6 and the vacuum producing material container 4 is removed. During the ink jet recording operation, this is repeated, so that a constant certain level of vacuum is maintained in the ink cartridge. All of the ink in the ink container 6 can be used up, except for the ink deposited on the internal wall surface of the ink container 6, and therefore, the ink use efficiency is high (FIG. 16(*c*)).

When the recording operation is not carried out, the capillary force of the vacuum producing material 3 itself (or the meniscus force at the interface between the ink and the vacuum producing material) appears to prevent the leakage of the ink from the ink jet recording head.

Figure 18:
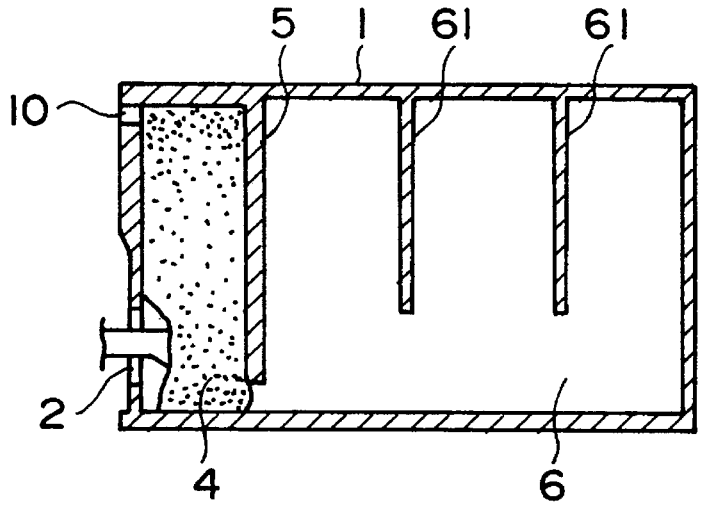
FIG. 18 is a sectional view of a modified example of an ink cartridge according to an embodiment of the present invention.

FIG. 18 shows a further embodiment in which the ink container 6 is provided with a plurality of partition walls 61, in consideration of the volume ratio between the vacuum producing material container 4 and the ink container 6 and the selection of the material of the vacuum producing material 3 in accordance with the ink jet recording head used with the ink container.

A description will be made as to the reinforcement of the side wall.

In the ink cartridge, it is desirable that the ink cartridge be durable against external force and ambient condition changes during transportation, while maintaining high use efficiency.

In this embodiment, the amount of deformations are equivalent in the vacuum producing member container 4 and the ink container 6 when the external forces are applied to the side walls 12*a*, 12*b* and 12*c*. For example, the cartridge is usually made by molding a plastic material. As shown in FIGS. 15(B) and 17, the thickness of the side wall 12*a* of the vacuum producing material container 4 is larger than the thickness of the side walls 12*b* and 12*c* of the ink container portion 6, and a partition wall (rib) 61 is disposed to extend between the opposite side walls, leaving the clearance at the bottom, at a position to divide the space into two equal space in the ink container 6. In addition, the deformation $\delta t_6$ of the wall responsive to the equivalent loads per unit area is made small, and the deformations of the side walls 12*b* and 12*c* at the opposite ends of the rib 61, are equivalent. By making the amount of deformation $\delta t_4$ of the vacuum producing material container 4 equivalent thereto, the leakage of the ink due to the deformation of the wall can be prevented.

In the ink cartridge shown in FIG. 15(B) and FIG. 7, the material of the wall is polypropylene (PP), and the outer dimensions are as follows: 48 mm in length, 35 mm in height, 11 mm in thickness. In this case, it is divided into the vacuum producing material container 4 and the ink container 6 substantially at the center of the length of 48 mm. The side wall 12*a* of the vacuum producing material container 4 has a thickness of 1.5 mm, and the side walls 12*b* and 12*c* of the ink container 6 have a thickness of 1 mm, and the rib 61 of the ink container 6 is disposed approx. 10 mm away from the wall surface. By doing so, more than twice margin can be provided against the handling load (approx. 2 kg). Simultaneously, sufficient strength can be provided against the pressure change during the transportation and the temperature range.

In this embodiment, only one rib 61 is provided in the ink container 6 because of the size of the ink container. However, the number thereof is not limited, and two ribs 61 may be provided as shown in FIG. 18 in accordance with the size of the ink cartridge. Furthermore, the number, position and the wall thickness of the ribs can be properly determined by skilled in the art.

Figure 20:
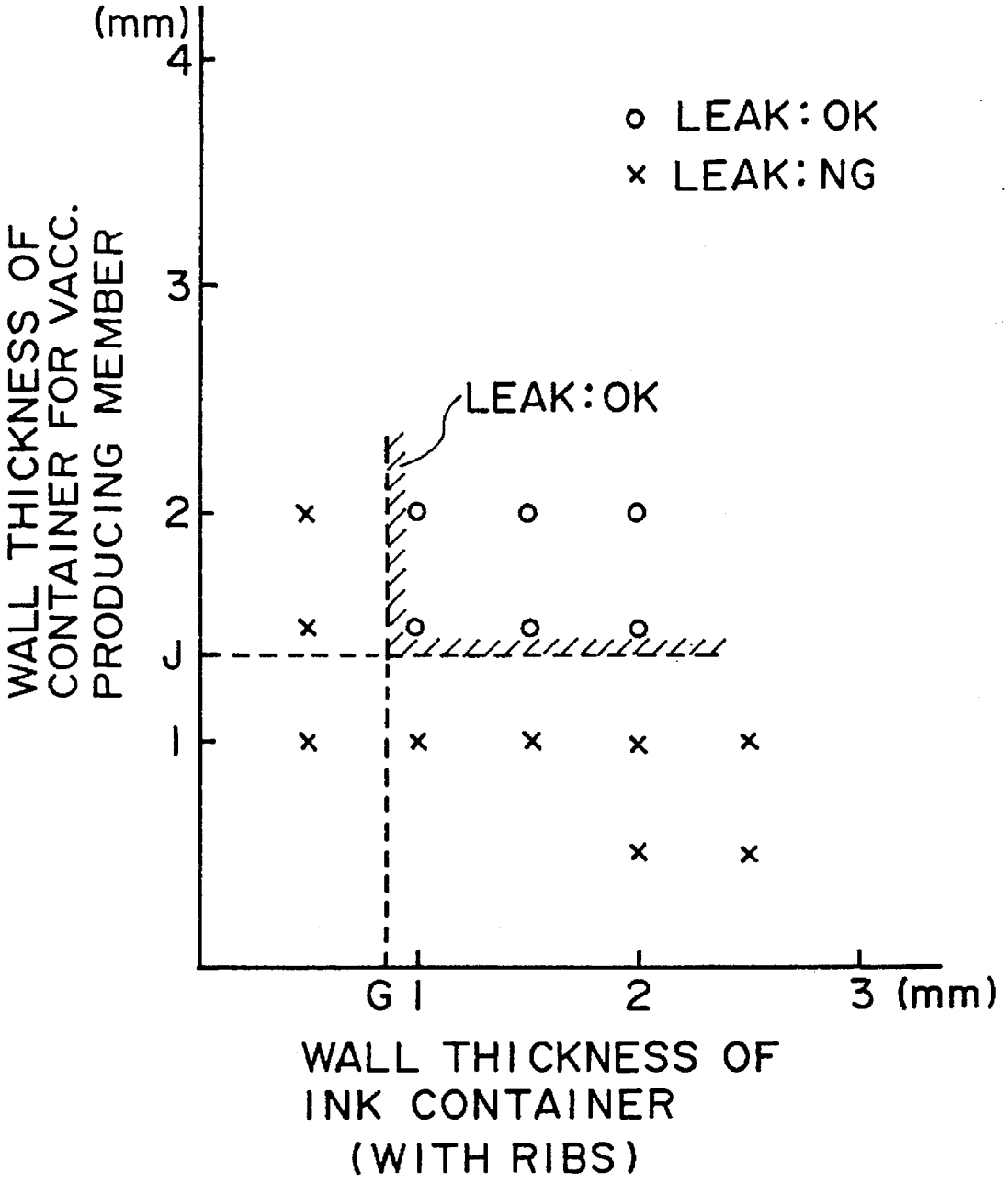
FIG. 20 is a graph showing a relation between the thickness of the wall and ink leakage by external pressure.

FIG. 20 shows a relation of the ink leakage during the handling and the transportation with the wall thickness of the vacuum producing material container 4 and wall thicknesses of various walls, investigated for the purpose of determining the wall thickness of the ink container 6.

Increase of thickness of any wall results in increase of the resistance against the ink leakage. However, from the standpoint of size reduction and high use efficiency of the ink, the smaller wall thickness is preferable to increase the internal volume. On the basis of the data shown in FIG. 20, a wall thickness of 1.5 mm was used for the side wall of the vacuum producing member container 4, and the side wall thickness of 1.0 mm was used for the ink container 6.

On the basis of the size of the ink cartridge, the above-described dimension may be determined on the basis of the data of this Figure. It is preferable that the wall thickness of the vacuum producing material container 4 is 1.3–3 times the wall thickness of the ink container 6.

While the invention has been described with reference to the structures disclosed herein, it is not confined to the details set forth and this application is intended to cover such modifications or changes as may come within the purposes of the improvements or the scope of the following claims.

What is claimed is:

1. A method of making a container for a replaceable ink cartridge for a bubble jet printer, the method comprising the steps of:

molding a one-piece container body comprising a front wall, a back wall and a top wall, each of which is elongated, and two side walls which provide major surfaces of said replaceable ink cartridge, said one-piece container body having an open bottom and a partition attached to said side walls, said partition extending from said top wall to a position proximate to said open bottom to divide said one-piece open container body into a first compartment formed by said partition and said back wall, said top wall and said two side walls and a second compartment defined by said partition and said front wall, said top wall and said two side walls;

inserting a sponge-like absorbent material into said second compartment through said open bottom; and sealing a bottom wall to said one-piece container body to form a first chamber for an ink reservoir and comprising said first compartment and said bottom wall, a second chamber containing said absorbent material and comprising said second compartment and said bottom wall, and a gap between said bottom wall and said partition which provides an opening of between 0.1 mm and 20 mm between said first chamber and said second chamber.

2. A method as in claim 1, wherein sealing of said bottom wall to said one-piece container body provides an opening of between 0.5 mm and 5 mm between said first chamber and said second chamber.

3. A method as in claim 1, wherein said side walls of said second chamber have a thickness that is 1.3 to 3 times as thick as said side walls of said first chamber.

4. A method as in claim 1, further comprising introducing liquid ink into said first chamber whereby an ink reservoir is provided in said first chamber and ink is introduced through said opening between said first chamber and said second chamber to partially fill said second chamber.

5. A method as in claim 4, wherein the front wall of said one-piece container body has an ink supply outlet for supplying ink to said bubble jet printer and an air vent hole for admitting ambient air into said second chamber and further comprising placing a sealing member over said ink supply outlet and air vent.

6. A method as in claim 5, wherein said bottom wall has a sealable access opening into said first chamber and wherein the introduction of liquid ink into said first chamber is carried out by introducing liquid ink through said access opening and thereafter closing said access opening.

7. A method as in claim 6, wherein the closing of said access opening is carried out by inserting a ball member in said access opening.

8. A method as in claim 7, wherein sealing of said bottom wall to said one-piece container body provides an opening of between 0.5 mm and 5 mm between said first chamber and said second chamber.

9. A method as in claim 8, wherein molding of the one-piece container body and sealing of said bottom wall to said one-piece container body form said first chamber and said second chamber with a volume ratio between 1:1 and 3:1.

10. A method as in claim 8, wherein the step of inserting said sponge-like absorbent material and the step of sealing said bottom wall to said one-piece container body are carried out so as to lessen compression of said sponge-like absorbent material at said opening.

11. A method of making a container for a replaceable ink cartridge for a bubble jet printer, the method comprising the steps of:

obtaining a one-piece container body comprising a front wall, a back wall and a top wall, each of which is elongated, and two side walls which provide major surfaces of said replaceable ink cartridge, said one-piece container body having an open bottom and a partition attached to said side walls, said partition extending from said top wall to a position proximate to said open bottom to divide said one-piece open container body into a first compartment formed by said partition and said back wall, said top wall and said two side walls and a second compartment defined by said partition and said front wall, said top wall and said two side walls;

inserting a sponge-like absorbent material into said second compartment through said open bottom; and sealing a bottom wall to said one-piece container body to form a first chamber for an ink reservoir and comprising said first compartment and said bottom wall, a second chamber containing said absorbent material and comprising said second compartment and said bottom wall, and a gap between said bottom wall and said partition which provides an opening of between 0.1 mm and 20 mm between said first chamber and said second chamber.

12. A method as in claim 11, wherein sealing of said bottom wall to said one-piece container body provides an opening of between 0.5 mm and 5 mm between said first chamber and said second chamber.

13. A method as in claim 11, wherein said side walls of said second chamber have a thickness that is 1.3 to 3 times as thick as said side walls of said first chamber.

14. A method as in claim 11, further comprising introducing liquid ink into said first chamber whereby an ink reservoir is provided in said first chamber and ink is introduced through said opening between said first chamber and said second chamber to partially fill said second chamber.

15. A method as in claim 14, wherein the front wall of said one-piece container body has an ink supply outlet for supplying ink to said bubble jet printer and an air vent hole for admitting ambient air into said second chamber and further comprising placing a sealing member over said ink supply outlet and air vent.

16. A method as in claim 15, wherein said bottom wall has a sealable access opening into said first chamber and wherein the introduction of liquid ink into said first chamber is carried out by introducing liquid ink through said access opening and thereafter closing said access opening.

17. A method as in claim 16, wherein the closing of said access opening is carried out by inserting a ball member in said access opening.

18. A method as in claim 17, wherein sealing of said bottom wall to said one-piece container body provides an opening of between 0.5 mm and 5 mm between said first chamber and said second chamber.

19. A method as in claim 18, wherein the obtained one-piece container body and sealing of said bottom wall to said one-piece container body form said first chamber and said second chamber with a volume ratio between 1:1 and 3:1.

20. A method as in claim 18, wherein the step of inserting said sponge-like absorbent material and the step of sealing said bottom wall to said one-piece container body are carried out so as to lessen compression of said sponge-like absorbent material at said opening.

21. An ink cartridge making method comprising the steps of:

molding a one-piece container body comprising a front wall, a back wall and a top wall, each of which is elongated, and two side walls which provide major surfaces of said replaceable ink cartridge, said one-piece container body having an open bottom and a partition attached to said side walls, said partition extending from said top wall to a position proximate to said open bottom to divide said one-piece open container body into a first compartment formed by said partition and said back wall, said top wall and said two side walls and a second compartment defined by said partition and said front wall, said top wall and said two side walls;

inserting a sponge-like absorbent material into said second compartment through said open bottom;

sealing a bottom wall to said one-piece container body to form a first chamber comprising said first compartment and said bottom wall, said first chamber having a sealable access opening, a second chamber containing said absorbent material and comprising said second compartment and said bottom wall, said second chamber having an ink supply outlet for supplying ink to said bubble jet printer and an air vent hole for admitting ambient air into said second chamber, and a gap between said bottom wall and said partition which provides an opening of between 0.1 mm and 20 mm between said first chamber and said second chamber;

introducing liquid ink into said first chamber through said access opening, whereby an ink reservoir is provided in said first chamber; and thereafter sealing said access opening.

22. A method as in claim 21, wherein sealing of said bottom wall to said one-piece container body provides an opening of between 0.5 mm and 5 mm between said first chamber and said second chamber.

23. A method as in claim 21, wherein said side walls of said second chamber have a thickness that is 1.3 to 3 times as thick as said side walls of said first chamber.

24. A method as in claim 21, wherein ink is introduced through said opening between said first chamber and said second chamber to partially fill said second chamber during said introducing step.

25. A method as in claim 24, wherein said ink supply outlet and said air vent hole are in said front wall and said method further comprises placing a sealing member over said ink supply outlet and said air vent.

26. A method as in claim 25, wherein said sealable access opening is in said bottom wall.

27. A method as in claim 26, wherein the closing of said access opening is carried out by inserting a ball member in said access opening.

28. A method as in claim 27, wherein sealing of said bottom wall to said one-piece container body provides an opening of between 0.5 mm and 5 mm between said first chamber and said second chamber.

29. A method as in claim 28, wherein sealing of said bottom wall to said one-piece container body forms said first chamber and said second chamber with a volume ratio between 1:1 and 3:1.

30. A method as in claim 28, wherein the step of inserting said sponge-like absorbent material and the step of sealing said bottom wall to said one-piece container body are carried out so as to lessen compression of said sponge-like absorbent material at said opening.

31. An ink cartridge making method comprising the steps of:

obtaining a one-piece container body comprising a front wall, a back wall and a top wall, each of which is elongated, and two side walls which provide major surfaces of said replaceable ink cartridge, said one-piece container body having an open bottom and a partition attached to said side walls, said partition extending from said top wall to a partition proximate to said open bottom to divide said one-piece open container body into a first compartment formed by said partition and said back wall, said top wall and said two side walls and a second compartment defined by said partition and said front wall, said top wall and said two side walls;

inserting a sponge-like absorbent material into said second compartment through said open bottom;

sealing a bottom wall to said one-piece container body to form a first chamber comprising said first compartment and said bottom wall, said first chamber having a sealable access opening, a second chamber containing said absorbent material and comprising said second compartment and said bottom wall, said second chamber having an ink supply outlet for supplying ink to said bubble jet printer and an air vent hole for admitting ambient air into said second chamber, and a gap between said bottom wall and said partition which provides an opening of between 0.1 mm and 20 mm between said first chamber and said second chamber;

introducing liquid ink into said first chamber through said access opening, whereby an ink reservoir is provided in said first chamber; and thereafter sealing said access opening.

32. A method as in claim 31, wherein sealing of said bottom wall to said one-piece container body provides an opening of between 0.5 mm and 5 mm between said first chamber and said second chamber.

33. A method as in claim 31, wherein said side walls of said second chamber have a thickness that is 1.3 to 3 times as thick as said side walls of said first chamber.

34. A method as in claim 31, wherein ink is introduced through said opening between said first chamber and said second chamber to partially fill said second chamber during said introducing step.

35. A method as in claim 34, wherein said ink supply outlet and said air vent hole are in said front wall and said method further comprises placing a sealing member over said ink supply outlet and said air vent.

36. A method as in claim 35, wherein said sealable access opening is in said bottom wall.

37. A method as in claim 36, wherein the closing of said access opening is carried out by inserting a ball member in said access opening.

38. A method as in claim 37, wherein sealing of said bottom wall to said one-piece container body provides an opening of between 0.5 mm and 5 mm between said first chamber and said second chamber.

39. A method as in claim 38, wherein sealing of said bottom wall to said one-piece container body forms said first and said second chamber with a volume ratio between 1:1 and 3:1.

40. A method as in claim 38, wherein the step of inserting said sponge-like absorbent material and the step of sealing said bottom wall to said one-piece container body are carried out so as to lessen compression of said sponge-like absorbent material at said opening.

41. A method of filling with ink a replaceable ink cartridge for a bubble jet printer, the method comprising the steps of:

obtaining an ink container made by (1) molding a one-piece container body comprising a front wall, a back wall and a top wall, each of which is elongated, and two side walls which provide major surfaces of said replaceable ink cartridge, said one-piece container body having an open bottom and a partition attached to said side walls, said partition extending from said top wall to a position proximate to said open bottom to divide said one-piece open container body into a first compartment formed by said partition and said back wall, said top wall and said two side walls and a second compartment defined by said partition and said front wall, said top wall and said two side walls, (2) inserting a sponge-like absorbent material into said second compartment through said open bottom, and (3) sealing a bottom wall to said one-piece container body to form a first chamber comprising said first compartment and said bottom wall, said first chamber having a sealable access opening, a second chamber containing said absorbent material and comprising said second compartment and said bottom wall, said second chamber having an ink supply outlet for supplying ink to said bubble jet printer and an air vent hole for admitting ambient air into said second chamber, and a gap between said bottom wall and said partition which provides an opening of between 0.1 mm and 20 mm between said first chamber and said second chamber;

introducing liquid ink into said first chamber through said access opening, whereby an ink reservoir is provided in said first chamber; and thereafter sealing said access opening.

42. A method as in claim 41, wherein said side walls of said second chamber have a thickness that is 1.3 to 3 times as thick as said side walls of said first chamber.

43. A method as in claim 41, wherein sealing of said bottom wall to said one-piece container body provides an opening of between 0.5 mm and 5 mm between said first chamber and said second chamber.

44. A method as in claim 43, wherein said ink supply outlet and said air vent hole are in said front wall and said method further comprises placing a sealing member over said ink supply outlet and said air vent.

45. A method as in claim 44, wherein said sealable access opening is in said bottom wall.

* * * * *

UNITED STATES PATENT AND TRADEMARK OFFICE

CERTIFICATE OF CORRECTION

PATENT NO. : 5,619,238

DATED : April 8, 1997

INVENTOR(S) : MASAHIKO HIGUMA, ET AL.

It is certified that error appears in the above-identified patent and that said Letters Patent is hereby corrected as shown below:

COLUMN 1

Line 23, "ejection orifices" should read --ink jet recording head having a plurality of ejection orifices.--

COLUMN 3

Line 27, "that adjacent" should read --that is adjacent--.

COLUMN 5

Line 11, "illustrates" should read --illustrate--.

COLUMN 6

Line 28, "member 8" should read --partition wall 5--.
Line 63, "another" should read --other--.

COLUMN 10

Line 1, "determined" should read --determined by--.
Line 20, "preferably" should read --preferably be made--.

UNITED STATES PATENT AND TRADEMARK OFFICE

CERTIFICATE OF CORRECTION

PATENT NO. : 5,619,238

DATED : April 8, 1997

INVENTOR(S) : MASAHIKO HIGUMA, ET AL.

It is certified that error appears in the above-identified patent and that said Letters Patent is hereby corrected as shown below:

COLUMN 15

Line 59, "skilled" should read --one skilled--.

COLUMN 19

Line 25, "partition" should read --position--.

Signed and Sealed this

Twenty-seventh Day of July, 1999

*Attest:*

Q. TODD DICKINSON

*Attesting Officer*

*Acting Commissioner of Patents and Trademarks*